US005410219A

United States Patent [19]

Takei et al.

[11] Patent Number: 5,410,219

[45] Date of Patent: Apr. 25, 1995

[54] PLASMA DISPLAY PANEL AND A METHOD FOR DRIVING THE SAME

[75] Inventors: Makoto Takei; Kazuo Takahashi; Koichi Wani; Mutsumi Mimasu; Utaro Miyagawa, all of Takatsuki; Akiko Tamura, Hirakata, all of Japan

[73] Assignee: Matsushita Electronics Corporation, Osaka, Japan

[21] Appl. No.: 117,742

[22] Filed: Sep. 7, 1993

Related U.S. Application Data

[63] Continuation of Ser. No. 826,693, Jan. 28, 1992, abandoned.

[30] Foreign Application Priority Data

| | | | |
|---|---|---|---|
| Feb. 5, 1991 | [JP] | Japan | 3-014345 |
| Jun. 28, 1991 | [JP] | Japan | 3-158528 |
| Jul. 2, 1991 | [JP] | Japan | 3-161460 |
| Nov. 7, 1991 | [JP] | Japan | 3-291163 |

[51] Int. Cl.[6] ..... G09G 3/10

[52] U.S. Cl. ..... 315/169.4; 315/169.2; 345/60

[58] Field of Search ..... 315/169.4, 169.2, 244, 315/209 R, 246; 313/581, 582, 583, 609, 610; 340/771, 784, 784 D, 784 E, 805; 345/60

[56] References Cited

U.S. PATENT DOCUMENTS

| | | | |
|---|---|---|---|
| 4,326,148 | 4/1982 | Okamoto et al. | 315/169.4 |
| 4,562,434 | 12/1985 | Amano | 315/169.4 |
| 4,692,666 | 9/1987 | Okamoto et al. | 315/169.4 |
| 4,799,058 | 1/1989 | Okamoto et al. | 315/169.4 |
| 4,816,816 | 3/1989 | Usui | 340/784 E |
| 4,845,473 | 7/1989 | Matsuhashi et al. | 340/784 E |
| 4,924,148 | 5/1990 | Schwartz | 315/169.4 |
| 4,982,183 | 1/1991 | Flegal et al. | 340/781 |
| 4,996,460 | 2/1991 | Kim et al. | 313/586 |

FOREIGN PATENT DOCUMENTS

| | | |
|---|---|---|
| 0334748 | 9/1989 | European Pat. Off. . |
| 1581602 | 12/1980 | United Kingdom . |
| 1593004 | 7/1981 | United Kingdom . |
| 2085631 | 4/1982 | United Kingdom . |

OTHER PUBLICATIONS

Hiroshi Murakami et al., *The Institute of Television Engineers of Japan Technical Report,* vol. 9, No. 13, pp. 13–18, Aug. 27, 1985 "Improvement on Planar Pulse Discharge Panel for a Color TV Display" (w/English translation).

*Primary Examiner*—Robert J. Pascal
*Assistant Examiner*—Michael B. Shingleton
*Attorney, Agent, or Firm*—Panitch Schwarze Jacobs & Nadel

[57] ABSTRACT

A method for driving a plasma display panel comprising a plurality of first electrodes disposed in parallel with each other, a plurality of second electrodes disposed in parallel with each other and perpendicular to the first electrodes, the second electrodes having a plurality of blocks, and a driving means to apply pulses to the second electrodes, wherein the different electrodes belonging to the different blocks are successively scanned in the predetermined order. Alternatively, the different electrodes may be scanned by repeating applications of pulse to a second electrode belonging to a certain block and to a second electrode belonging to either of the adjacent blocks.

24 Claims, 10 Drawing Sheets

PLASMA DISPLAY PANEL AND A METHOD FOR DRIVING THE SAME

This application is a continuation of application Ser. No. 07/826,693, filed Jan. 28, 1992, now abandoned.

BACKGROUND OF THE INVENTION

1. Field of the Invention

The present invention relates to a method for driving a plasma display panel and the structure thereof and more particularly to a method for driving a plasma display panel of the pulse memory system and the structure thereof.

2. Description of the Prior Art

A plasma display panel (PDP) with a color display has recently been desired in place of a color CRT, which is used as a display device for office automation equipment such as a personal computer, drastically thinner. However, the color display of the DC plasma display panel tends to have a low luminance. This is because every color is indicated by exciting a fluorescent material using a gas to emit ultraviolet rays such as xenon as a discharge gas, thereby reducing the performance of conversion into visible light. The pulse memory system has been known as an art to solve the problem (for example, as described in The Institute of Television Engineers of Japan Technical Report, Vol. 9, No. 13, pages 13–18. The system will be described as follows:

As shown in FIG. 10, a panel includes two kinds of a plurality of display matrix electrodes: A plurality of cathodes 31 consisting of cathodes $K_1$, $K_2$, $K_3$, . . . , etc. and a plurality of display anodes 32 consisting of display anodes $A_1$, $A_2$, $A_3$, . . . , etc. which are perpendicular to the cathodes. The panel further has a plurality of sub anodes 33 consisting of sub anodes $S_1$, $S_2$, $S_3$, . . . , etc. In addition, the panel also has a glass plate 41 on the outside of the display anodes 32 and a backboard 42 on the outside of the cathodes 31. A fluorescent material 43 is mounted on the glass plate 41. Each of the cathodes 31 and the anodes 32 are separated by walls 44 with a predetermined interval therebetween, thereby providing spaces 45 and 46 acting as a display discharge cell and a sub discharge cell, respectively. Most of the walls 44 have spaces between the glass plate 41 above the walls, thereby forming priming paths 47. The priming path 47 introduces the sub discharge occurring at the sub discharge cell 46 to the display discharge cell 45.

Referring to FIG. 11, a method for driving the pulse memory system will now be described. Keeping pulses $V_a$ are always applied to the display anodes 32 ($A_1$, $A_2$, $A_3$, . . . , etc.) and scanning pulses $V_k$ with negative potential are successively applied to the cathodes 31 from a negative electrode $K_1$. A fixed positive potential $V_s$ is applied to each of the sub anodes 33.

Sub discharge is always scanned at the sub discharge cell 46. The voltage $V_s$-$V_k$ is settled to be more than the ignition voltage of the sub discharge cell 46, resulting in the discharge of the sub discharge cell 46 every time scanning pulses are applied. These discharges successively shift to the adjacent sub discharge cells. Charged particles are produced in the sub discharge cell 46 by the sub discharge. These charged particles are diffused into the display discharge cells 45 adjacent to the sub discharge cell 46 through the priming paths 47, thereby reducing the delayed time of the ignition in the display discharge cell 45.

A pulse discharge occurs, for example, in the display discharge cell 45, which is an intersection of a display anode $A_2$ and a cathode $K_2$, when a writing pulse $V_w$ is being applied to a display anode $A_2$ while a scanning pulse is applied to a cathode $K_2$ as shown in FIG. 11. Thus the ignition voltage of the display discharge cell 45 having received a writing pulse is reduced. The display discharge cell 45 is further discharged and flashes every time a keeping pulse $V_a$ is applied until an erasing pulse $V_E$ is applied. The voltage of the erasing pulse $V_E$ is settled to make the voltage between the cathode and the display anode less than the ignition voltage. Therefore, discharge is stopped after the application of the erasing pulse.

When a writing pulse is not applied, or after discharge is stopped by the application of an erasing pulse, the ignition voltage of the display discharge cell is kept to be high, thereby preventing discharge and luminance by a keeping pulse.

In the PDP of the pulse memory system, pulse emissions repeating between the application of a writing pulse and an erasing pulse are utilized for displaying. Thus such a device has a high luminance efficient for practical use, which is reported as about 100 cd/m$^2$. It is possible to produce a panel with a cell pitch of about 0.6 mm.

FIG. 12 shows an example in which cathodes of the PDP of the pulse memory system are driven by IC's. A plurality of cathodes 11 are disposed perpendicular to a plurality of anodes 12. A discharge cell 6 is formed on a portion corresponding to the intersection of each of the cathodes 11 and the anodes 12. A sub anode is not shown in the drawing. A plurality of IC's 22 activate the cathodes 11. This is an example in which some of the adjacent plural cathodes are driven by one IC. As described above, the adjacent discharge cells having one anode in common sometimes discharge and flash at the same time. At this time, a current is flowing through the adjacent cathodes at the same time.

In order to produce the above PDP in a size of 10 to 15 inches, which is generally used for a personal computer and the like, a cell pitch needs to be less than 0.3 mm. However, according to the prior art, a cell pitch of about 0.3 mm leads to an inferior aperture ratio and insufficient area of the fluorescent material since the display discharge cell 45 is surrounded with the walls 44. Moreover, the discharge is not steady due to the drastically narrowed discharge space. Therefore, a practical luminance can not be obtained.

Additionally, mercury, used as a filler gas, is prevented from diffusing throughout all cells uniformly by the walls 44 as mercury is too heavy. Therefore, the density of mercury is kept low in the cell, where mercury fails to function to prevent the sputtering. Accordingly, partially reduced luminance and discoloration are caused, and in an extreme case, the lifetime of the panel is shortened.

Moreover, in the PDP driven in the conventional pulse memory system, the cathodes are driven by a plurality of IC's 22 as shown in FIG. 12, thereby allowing a current to flow through a plurality of cathodes connected to one IC at the same time when the panel is switched on. Therefore, the IC needs to have a large current capacity, resulting in a difficulty in integrating the drive circuits of the cathodes.

The present invention relates to a plasma display panel and the driving method thereof to solve the above problems. According to the device and the method, the number of the walls parallel to the cathodes is reduced, thereby increasing the aperture ratio. In addition, a high luminance is obtained in a panel with a small cell pitch required for office automation equipment. Furthermore, according to the present invention, mercury is easy to diffuse, thereby increasing the effect to prevent sputtering of the cathodes and further increasing the lifetime of the panel. When the cathodes are driven by the IC's, a current flowing through one IC at the same time is reduced, and the required current capacity of the IC is also reduced. Thus the drive circuit of the cathode can easily be integrated.

SUMMARY OF THE INVENTION

The method of this invention, which overcomes the above-discussed and numerous other disadvantages and deficiencies of the prior art, comprises the steps of preparing a plasma display panel having a plurality of first electrodes, a plurality of second electrodes disposed in parallel with each other and perpendicular to the first electrodes, the second electrodes having a plurality of blocks, and a driving means to apply pulses to the second electrodes, and successively scanning the different electrodes belonging to the different blocks in the predetermined order.

In a preferred embodiment, the plasma display panel comprises a plurality of first electrodes disposed in parallel with each other, a plurality of second electrodes disposed in parallel with each other and perpendicular to the first electrodes, the second electrodes having a plurality of blocks, a driving means to apply pulses to the second electrodes and a discharge space in a matrix.

In a preferred embodiment, applications of a pulse to a second electrode belonging to a certain block and to a second electrode belonging to either of the adjacent blocks are repeated.

In a preferred embodiment, the plasma display panel comprises a highly conductive material on each of a plurality of walls parallel to the first electrodes.

In a preferred embodiment, the plasma display panel comprises mercury as a discharge gas between the first electrodes and the second electrodes.

Thus, the invention described herein makes possible the objectives of providing (1) a plasma display panel and the driving method thereof, (2) a plasma display panel with fewer walls parallel to the cathodes and an increased aperture ratio and the driving method thereof, (3) a plasma display panel with a small cell pitch required for office automation equipment having a high luminance and the driving method thereof, (4) a long lasting plasma display panel in which mercury easily diffuses and thus the sputtering of the cathodes is effectively prevented and the driving method thereof and (5) a plasma display panel in which an IC with a small current capacity is used as a driving means which is easily integrated and the driving method thereof.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Example 1

Figure 1:
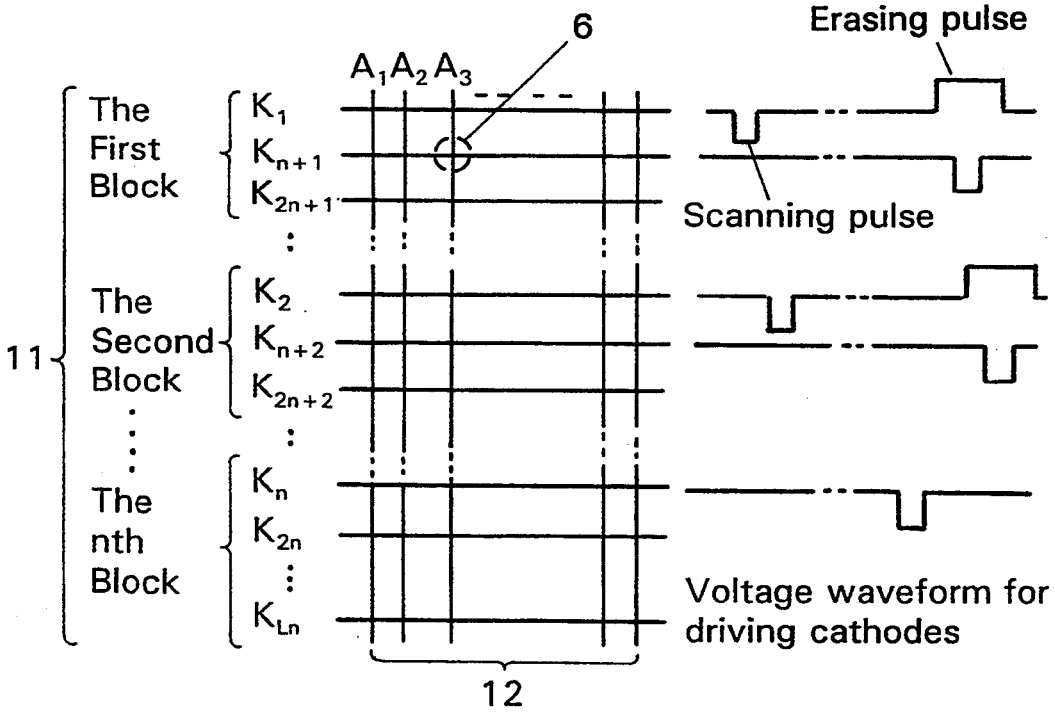
FIG. 1 shows an electrode structure and a driving waveform to describe a method for driving the plasma display panel according to the first example of the present invention.

Referring to FIG. 1, the first example of the present invention will be described.

Figure 12:
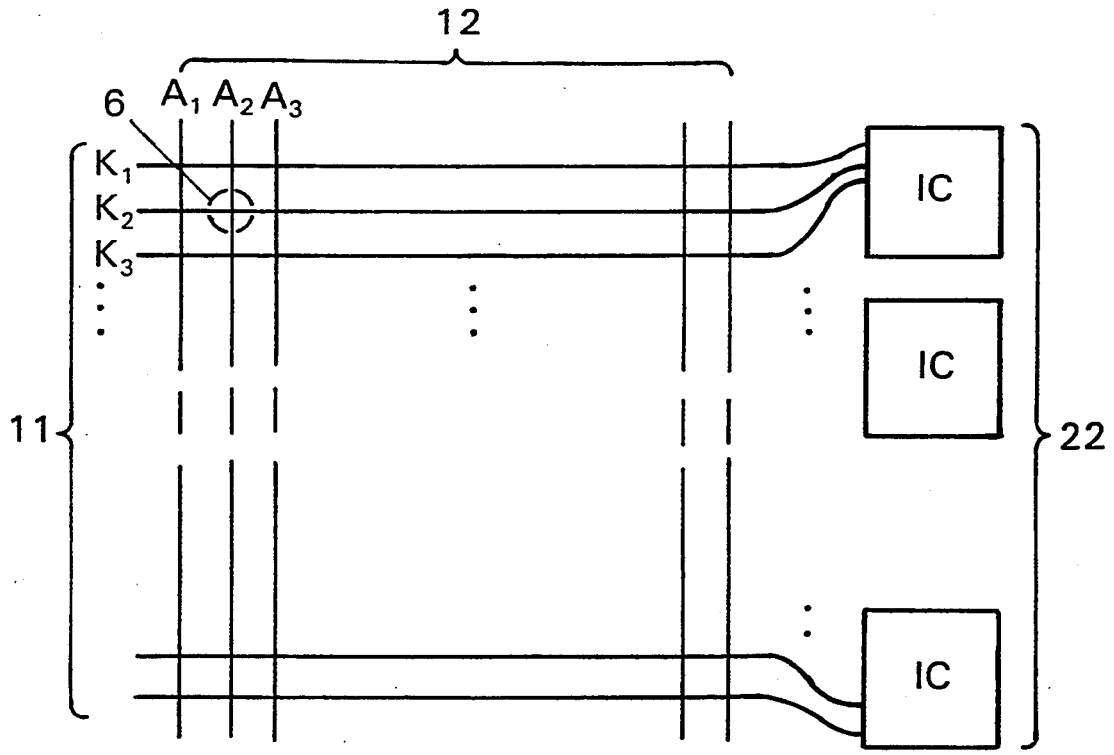
Fig. 12 PRIOR ART
FIG. 12 shows an electrode structure of a conventional plasma display panel.

A plurality of cathodes 11 are disposed parallel to each other. The cathodes are divided into n groups, each of the groups is called a block. Each of the n blocks includes a plurality of cathodes 11. The cathodes in each block are adjacent to each other. A plurality of anodes 12 parallel to each other are disposed perpendicular to the cathodes. Discharge cells 6 are formed on the intersections of the cathodes 11 and the anodes 12. The electrode structure of the PDP is the same as that of the conventional panel shown in FIG. 12. The difference is the method for driving the PDP, which will now be described in detail.

As shown in FIG. 1, the first block, the second block, . . . and the nth block are provided in this order from the top to the bottom. The cathodes included in the mth block are $K_m$, $K_{n+m}$, $K_{2n+m}$, . . . and $K_{(L-1)n+m}$, wherein L is a number of the cathodes included in each block. For example, when the total number of the cathodes is 480, L and n may be taken as 30 and 16, respectively.

In this example, scanning pulses are successively applied to the cathodes 11 divided into these blocks in the ascending order of the suffixes, that is, in the order of $K_1$, $K_2$, $K_3$, . . . , $K_{Ln-1}$ and $K_{Ln}$. The waveform of the anodes is the same as that of the conventional pulse memory system. When a writing pulse is applied to an anode during scanning cathodes, discharge occurs at a discharge cell on the intersection of the anode and the cathodes. The discharge is continued by keeping pulses until an erasing pulse is applied to the cathodes.

Figure 2:
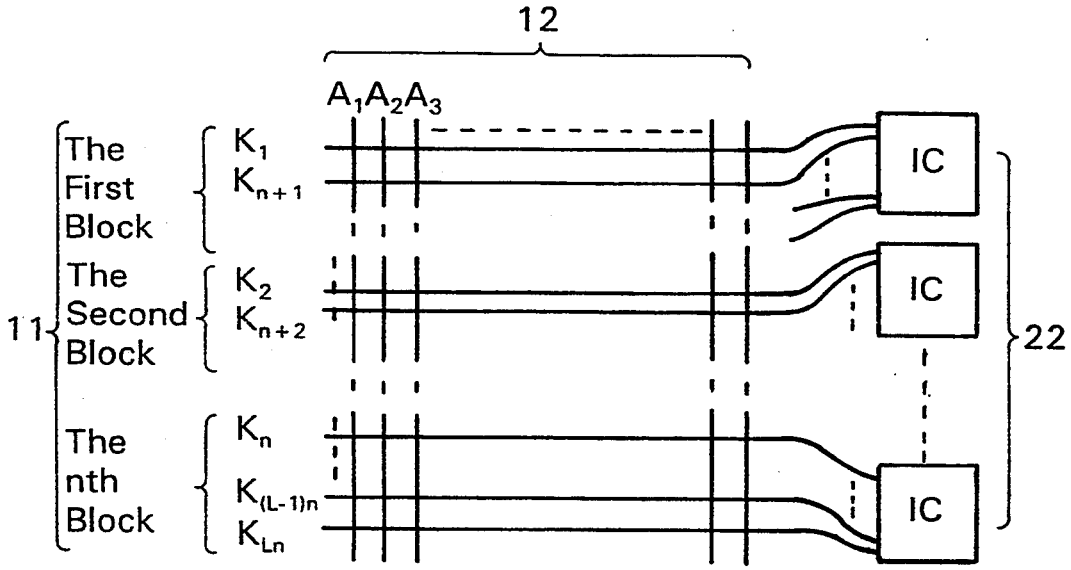
FIG. 2 shows an electrode structure and an IC layout of the plasma display panel according to the first example of the present invention.

Referring to FIG. 2, an example of the IC layout in which a plurality of cathodes 11 in one block are driven by one IC will now be described. For example, the total number of cathodes is 256, which are divided into 8 blocks and 32 cathodes are connected to one IC: n=8 and L=32 in FIG. 2. Eight cathodes, which are connected to different IC's respectively, are continuously scanned. A display with 256 gradations in the pulse memory system needs 128 continuous pulse discharges, wherein 16 cathodes among the 32 cathodes connected to the same IC discharge at the same time. On the other hand, in the conventional driving method, all the cathodes connected to the same IC, that is 32 cathodes in this case, discharge at the same time. Therefore, the present method enables the current capacity of the IC required to drive the panel to be half of that in the conventional method.

Figure 3:
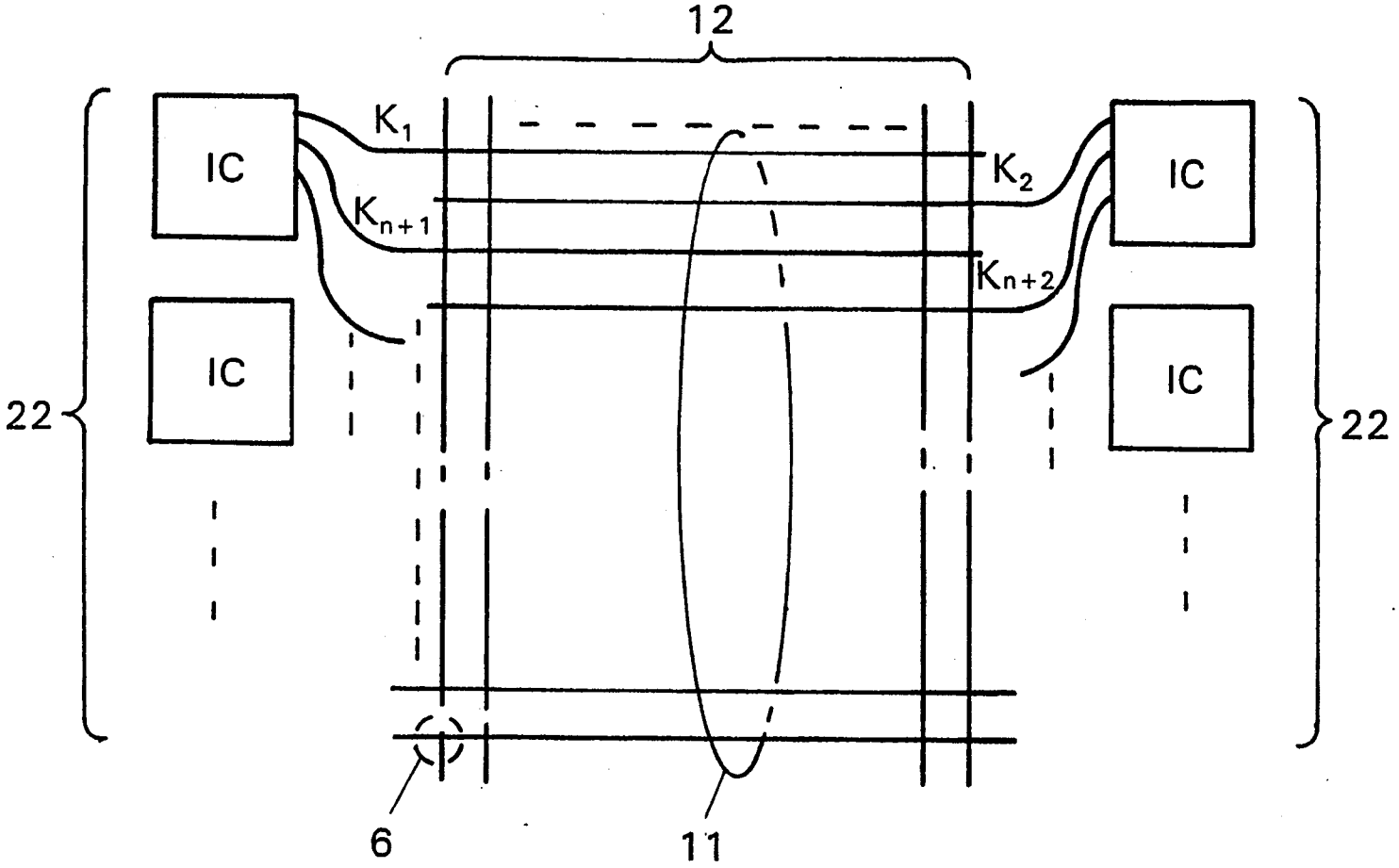
FIG. 3 shows an electrode structure and another IC layout of the plasma display panel according to the first example of the present invention.

Referring to FIG. 3, another example of the IC layout in which a plurality of cathodes 11 are driven by one IC. In this example IC's disposed on both sides of the anodes are connected to every other cathode, wherein n=8 and L=32 as described in the above layout. In this case, a group of the cathodes connected to the same IC are regarded as one block. As in the above layout, the current capacity of the IC required to drive the panel is half of that in the conventional method when scanning the cathodes in this layout.

As described above, when the cathodes are driven by the IC, the required current capacity of the IC can be half of that in the conventional method, thereby enabling the drive circuits of the cathodes to be easily integrated.

Example 2

Figure 4:
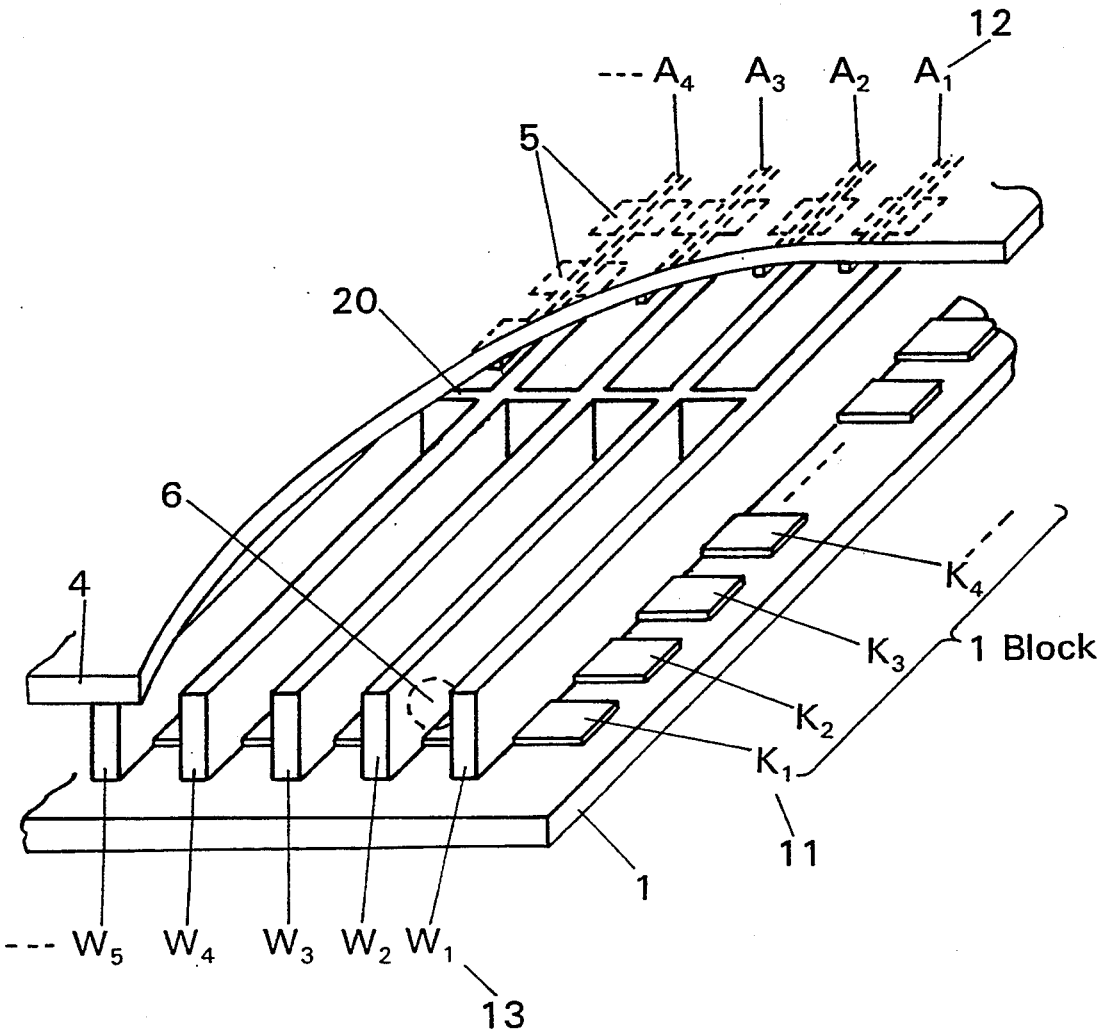
FIG. 4 is a structural view of the plasma display panel in the second and the seventh examples of the present invention.

Referring to FIG. 4, the second example of the present invention will now be described.

A plurality of cathodes 11 consisting of $K_1$, $K_2$, $K_3$, . . . , etc. are disposed on a backboard 1. A plurality of walls 13 in the shape of strips consisting of $W_1$, $W_2$, $W_3$, . . . , etc. are disposed perpendicular to the cathodes 11, thereby separating the space including the cathodes. L cathodes, for example L=16, are put together, thereby forming a block. A block wall 20 is provided between each block parallel to the cathodes 11. A plurality of anodes 12 consisting of $A_1$, $A_2$, $A_3$, . . . , etc. are disposed perpendicular to the cathodes 11 above the walls 13 and the block walls 20. Display cells 6 are formed on the intersections of cathodes 11 and anodes 12. A glass plate 4 coated with a fluorescent material 5 is provided over the anodes 12. The whole panel is hermetically sealed with a noble gas such as He—Xe—Kr mixed gas inside.

Figure 10A:
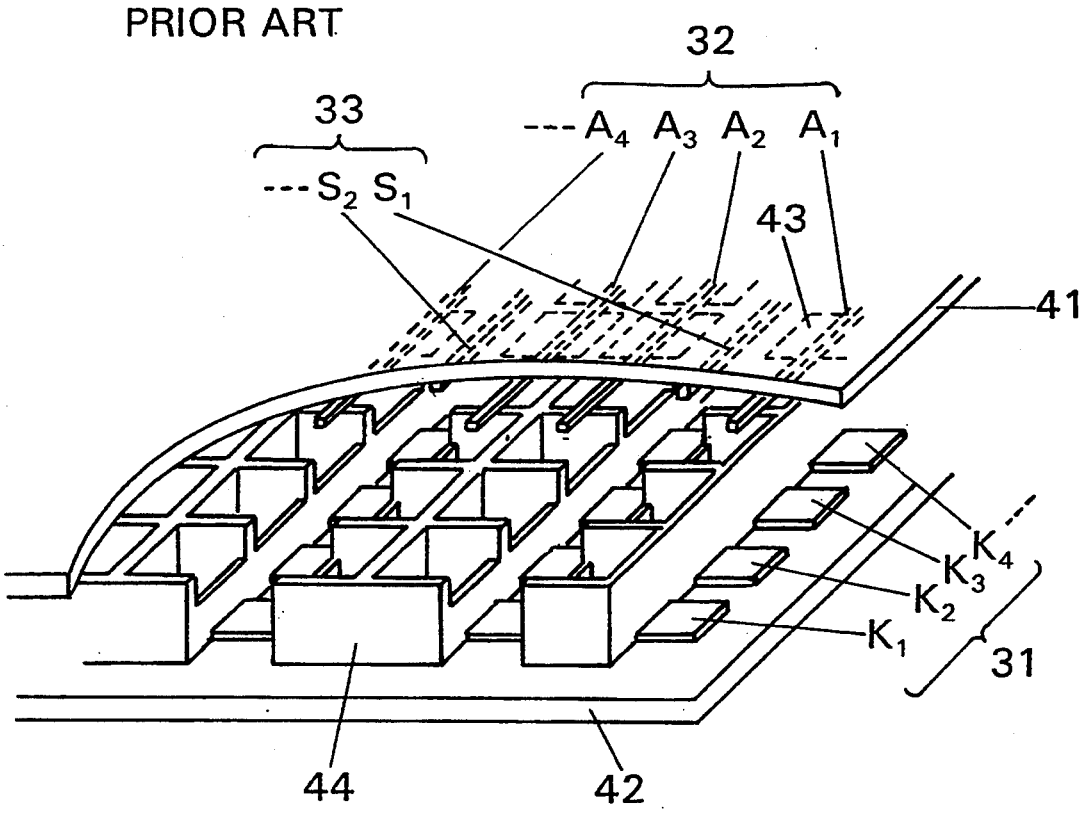
Fig. 10A PRIOR ART
FIG. 10A is a structural view of the plasma display panel of a conventional pulse memory system.
Figure 10B:
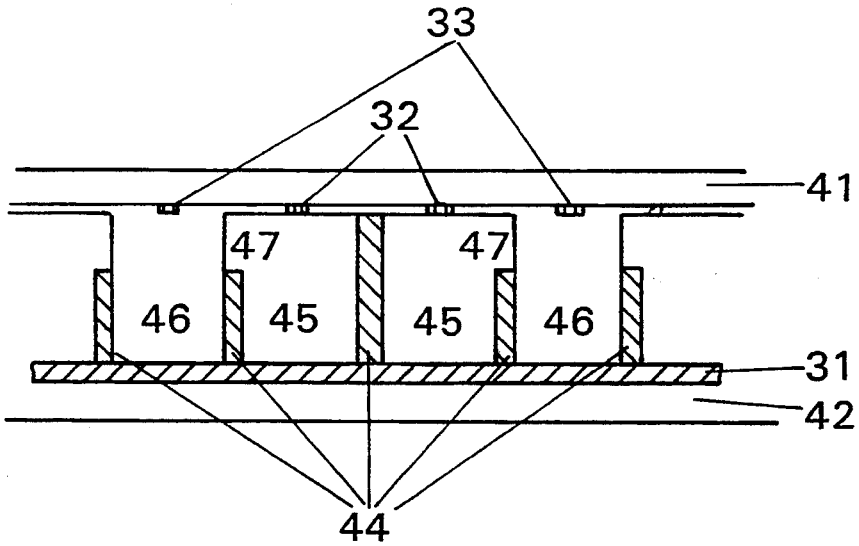
Fig. 10B PRIOR ART
FIG. 10B is a sectional view taken along the cathodes.
Figure 11:
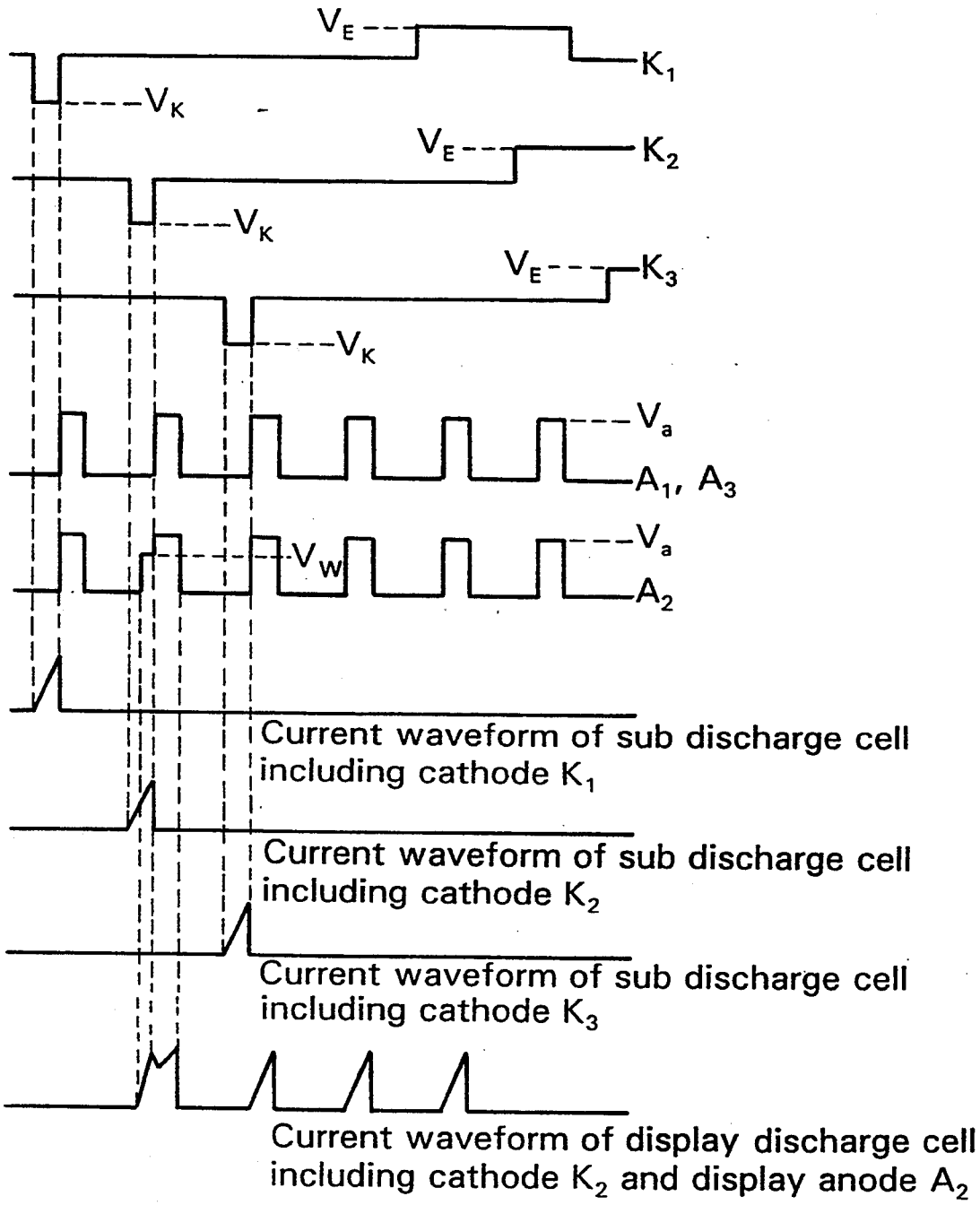
Fig. 11 PRIOR ART
FIG. 11 shows a driving waveform and a discharge current waveform to describe a method for driving the plasma display panel of the conventional pulse memory system.

The panel structure of this example does not have walls parallel to the cathodes such as walls 44 in the conventional structure shown in FIGS. 10A and 10B. Only block walls are provided to group some of the cathodes, which increases the aperture ratio of the discharge space. This is the essential difference from the panel structure of the conventional pulse memory system. Moreover, in the present example, for example, the sub discharge cells 46 shown in FIG. 10B are missing.

Figure 5:
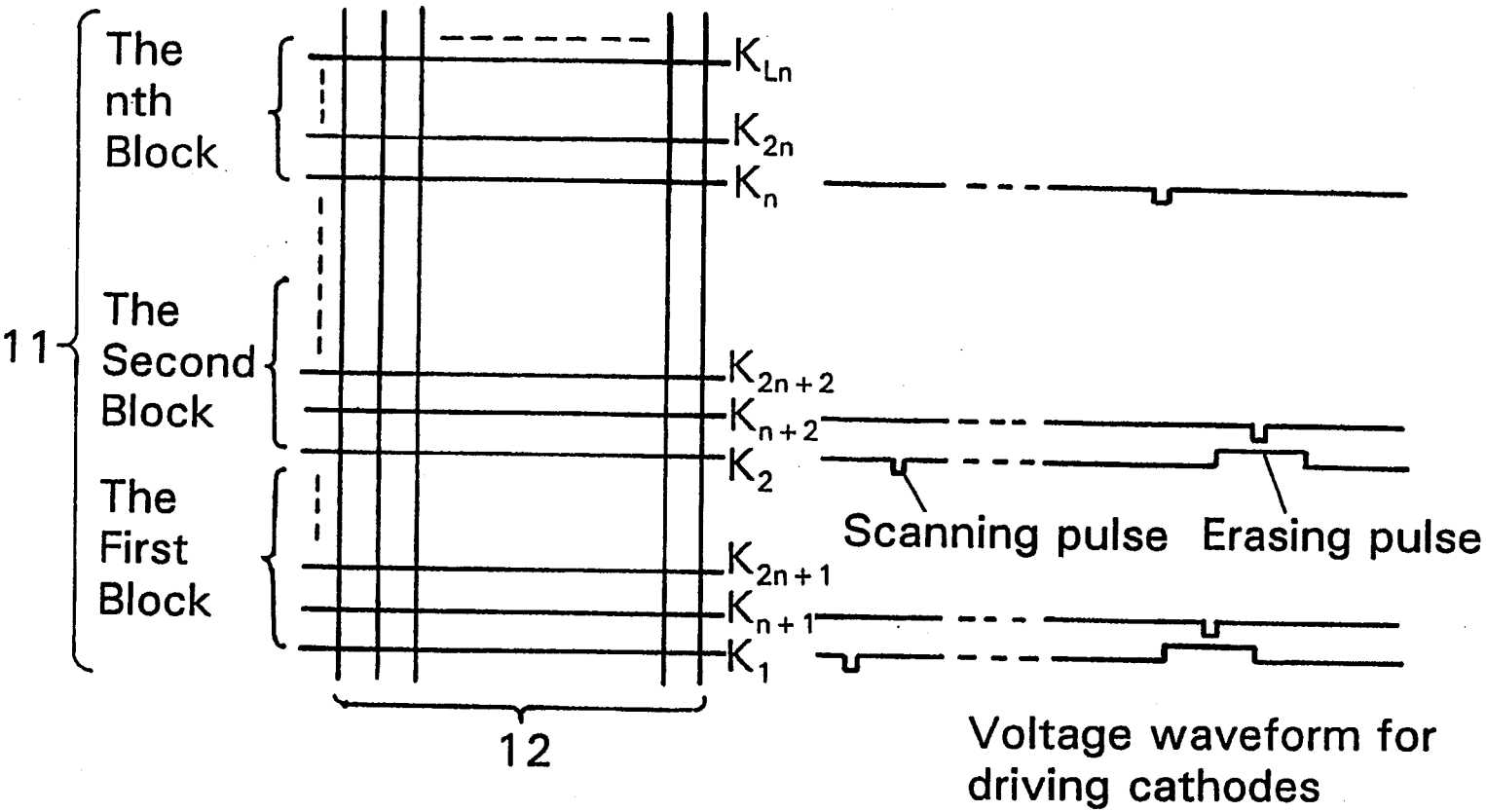
FIG. 5 shows an electrode structure and a driving waveform to describe a method for driving the plasma display panel according to the second and seventh examples of the present invention.

In the panel structure of this example, when the adjacent cathodes are applied successively as in the conventional pulse memory system, a misdisplay occurs because the panel has no wall parallel to the cathodes. A display cell which has just been applied with a writing pulse is kept on discharging by keeping pulses, thereby reducing the ignition voltage of the adjacent cells due to the charged particles produced in the cells. When the adjacent cells are scanned at this time, discharge is started by the scanning pulse even if there is no need to display the cell. Referring to FIG. 5, the driving method in this example to prevent the above misdisplay will be described.

A plurality of cathodes 11 are divided into n pieces of blocks. The cathodes included in each block are adjacent to each other. As shown in FIG. 5, the first block, the second block, . . . and the nth block are provided in this order from the bottom. The cathodes included in the mth block are $K_m$, $K_{n+m}$, $K_{2n+m}$, . . . and $K_{(L-1)n+m}$, wherein L is a number of the cathodes included in each block. For example, when the total number of cathodes is 480, L and n may be taken as 20 and 24, respectively. In this example, scanning pulses are applied to the cathodes 11 divided into these blocks in the ascending order of the suffixes, that is, in the order of $K_1$, $K_2$, $K_3$, . . . , $K_{Ln-1}$ and $K_{Ln}$. The waveform for driving the anodes is the same as that of the conventional pulse memory system. When writing pulses are applied to the anodes during scanning the cathodes, the display cells are discharged. The discharge is continued by keeping pulses until erasing pulses are applied to the cathodes. Before starting the application again to the same blocks, the erasing pulses are applied. Thus, the display discharge at two cathodes at the same time in the same block is prevented. Therefore, the cell having been applied with a writing pulse emits pulse light n times at most. Thus a high display luminance is obtained.

In this scanning method, one display cell at most is discharged at one time in the area surrounded by the walls 13 and the block walls 20. Moreover, the other display discharges are not effected, thereby preventing misdisplay in spite of the structure with fewer walls.

As described above, in this example, the aperture ratio is increased because the walls in the direction of the cathodes are removed. In this way, the plasma display panel in which the luminance is not reduced by the refined cells and the driving method thereof are obtained.

Example 3

Figure 6:
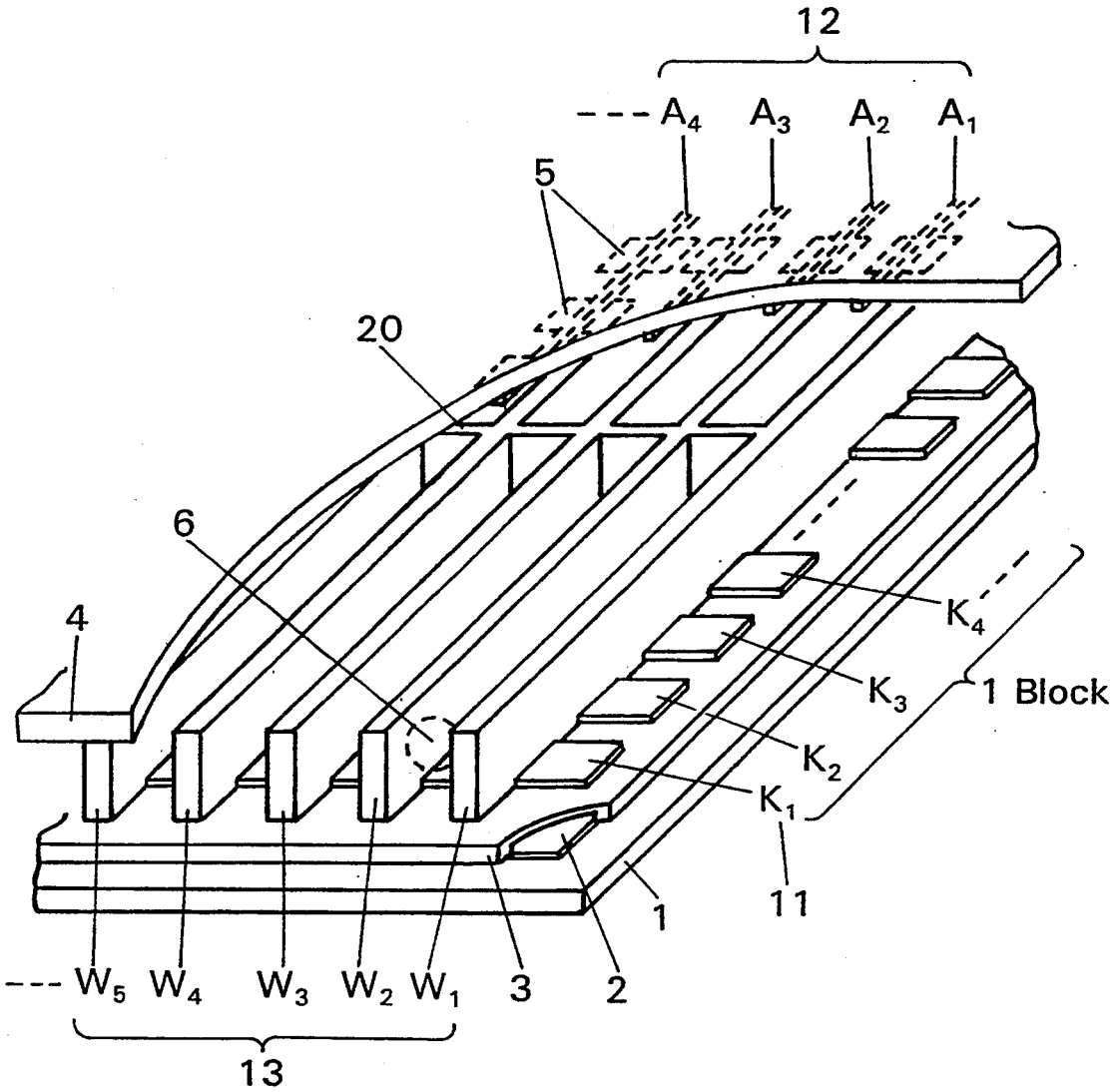
FIG. 6 is a structural view of the plasma display panel in the third, fifth and eighth examples of the present invention.

Referring to FIG. 6, the third example of the present invention will now be described.

The structural difference between this example and the second example is that a trigger electrode 2 is coated on a backboard 1, that a dielectric layer 3 is coated on the trigger electrode 2 and that a plurality of cathodes 11, a plurality of walls 13 and the like are disposed on the dielectric layer 3. The other structure is the same as that of the second example. The waveforms for driving the cathodes 11 and the anodes 12 are also the same.

The PDP of this example has no sub discharge cell such as a sub discharge cell 46 of the conventional panel shown in FIG. 10B, resulting in advantageously increasing the display density. However, in this PDP, the ignition by writing pulses can not be ensured due to the delay of the discharge of the display cell.

To overcome the above disadvantage, a pre-discharge system by a trigger electrode is applied in this example. A pulse with negative polarity is applied to the trigger electrode 2 immediately before beginning the scanning of the cathodes, thereby causing a slight pre-discharge at all the display cells. Part of the charged particles produced by the pre-discharge are stored on the dielectric layer. The display discharges are easily started because of these stored charge particles. Thus, a writing operation is ensured without sub discharge cells.

Therefore, in addition to the characteristics described in the second example, the plasma display panel with the trigger electrode in this example is characterized in that the operation during the pulse memory driving is ensured.

Example 4

Figure 7:
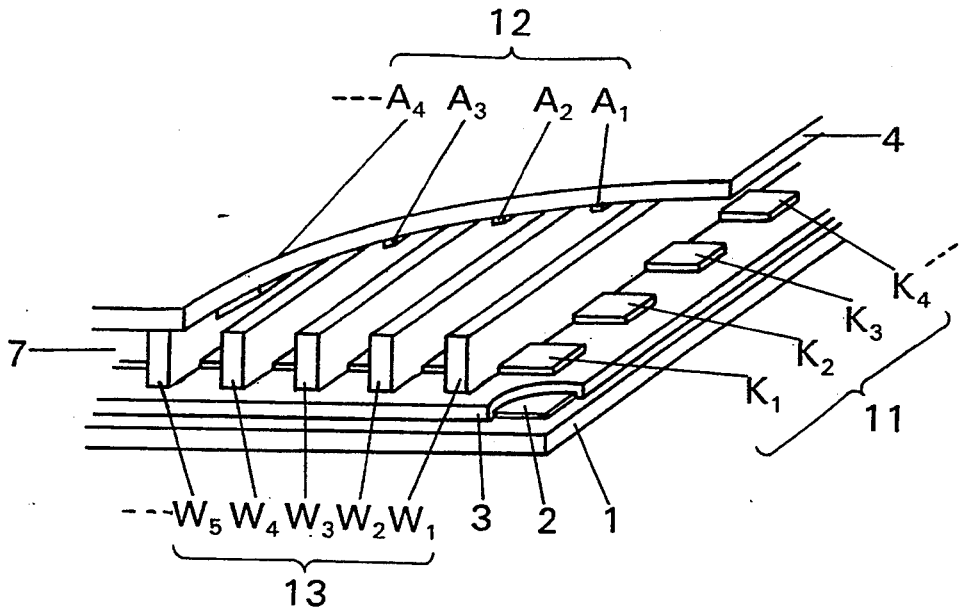
FIG. 7 is a structural view of the plasma display panel in the fourth example of the present invention.

Referring to FIG. 7, the fourth example of the present invention will now be described.

A dielectric layer 3 is coated on a trigger electrode 2, which is coated on a backboard 1. A plurality of cathodes 11 consisting of $K_1$, $K_2$, $K_3$, . . . , etc. are provided on the dielectric layer 3. A plurality of walls 13 in the shape of strips are provided perpendicular to the cathodes 11 and thus separating a discharge space 7, thereby forming display cells. A plurality of anodes 12 consisting of $A_1$, $A_2$, $A_3$, . . . , etc. are further provided perpendicular to the cathodes 11 over these display cells. A glass plate 4 is disposed over the anodes 12. The whole panel is hermetically sealed with a noble gas such as He—Xe—Kr mixed gas inside.

The panel structure of this example has no wall parallel to the cathodes such as the wall 44 in the conventional panel shown in FIG. 10, resulting in increasing the aperture ratio of the discharge space. This is the essential difference from the panel structure of the conventional pulse memory system. Moreover, the trigger electrode 2 and the dielectric layer 3 are used instead of the sub discharge cell in order to increase the density in the display discharge cell. The trigger discharge is caused by using the trigger electrode 2 and the dielectric layer 3.

Figure 8:
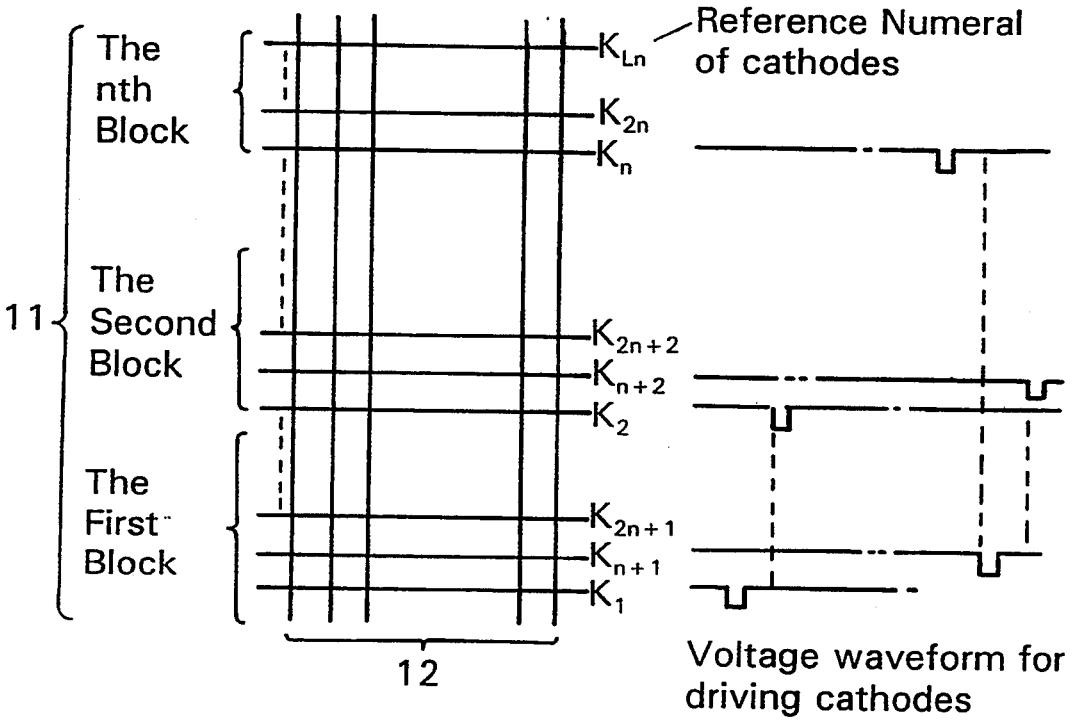
FIG. 8 shows an electrode structure and a driving waveform to describe a method for driving the plasma display panel according to the fourth example of the present invention.

In the panel structure of this example, when the adjacent cathodes are scanned successively as in the conventional pulse memory system, misdisplay occurs because the panel has no wall parallel to the cathodes. A display cell which has just been applied with a writing pulse is kept on discharging by keeping pulses, thereby reducing the ignition voltage of the adjacent cells due to the charged particles produced in the cells. When the adjacent cells are scanned at this time, discharge is started by the scanning pulses even if there is no need to display the cell. Referring to FIG. 8, the driving method in this example to prevent such misdisplay will be described.

A plurality of cathodes 11 are divided into n blocks. The cathodes in each block are adjacent to each other. As shown in FIG. 8, the first block, the second block, . . . and the nth block are provided in this order from the bottom. The cathodes included in the mth block are $K_m$, $K_{n+m}$, $K_{2n+m}$, . . . and $K_{(L-1)n+m}$, wherein L is a number of the cathodes included in each block. For example, when the total number of the cathodes is 480, L and n may be taken as 20 and 24, respectively. In this example, scanning pulses are applied to the cathodes 11 which are divided into these blocks in the ascending order of the suffixes, that is, in the order of $K_1$, $K_2$, $K_3$, . . . , $K_{Ln-1}$ and $K_{Ln}$.

In the method for scanning in this example, cathodes which are spaced apart from one another by n cathodes (that is, cathodes in adjacent blocks) are successively scanned, which is different from the conventional pulse memory system in which the adjacent cathodes are successively scanned. Moreover, discharge of an optional cell is stopped before the adjacent-cells are scanned, thereby preventing misdisplay due to the above cause. A trigger discharge is caused between the trigger electrode 2 and the cathodes 11 before scanning a cathode $K_1$, thereby storing the charge on the dielectric layer 3, reducing the ignition voltage for display discharge and also reducing the delay of the ignition time.

The waveform for driving the cathodes except for the order of scanning is the same as that of the conventional pulse memory system. The keeping pulses are always applied to the anodes. When writing pulses are applied to the anodes during scanning the cathodes, discharge starts. The discharge is continued by keeping pulses until erasing pulses are applied to the cathodes. Therefore, the cell to which a writing pulse was applied emits light until erasing pulses are applied. Thus, a high display luminance is obtained.

As described above, in this example, the aperture ratio is increased because the walls in the direction of the cathodes are removed. In this way, a plasma display panel in which the luminance is not reduced by the refined cells and the driving method thereof are obtained.

Example 5

Referring to FIG. 6, the fifth example of the present invention will now be described.

The structural difference between this example and the fourth example is that a block wall 20 is provided between the blocks described in the fourth example. The other structure including the driving method is the same as that of the fourth example.

In the driving method of this example, the cathodes spaced apart from a predetermined number of other cathodes are successively scanned. In other words, the cathodes in adjacent blocks are successively scanned. The discharge is continued by keeping pulses in the discharge space including the cathodes which have just been scanned. Due to the charged particles produced in this discharge space, discharge easily occurs in the other discharge space including the cathodes which will be scanned afterward. Therefore, the voltage range of keeping pulses for a stable memory operation, what is called a memory margin, is reduced. To overcome this problem, block walls between the blocks are provided in this example. These walls prevent the charged particles produced in the discharge space including the cathodes which have just been scanned from affecting the following discharge.

As described above, the plasma display panel with a large memory margin and the driving method thereof can be obtained by providing the block walls 20 between each block in addition to the panel structure of the fourth example.

Example 6

Figure 9:
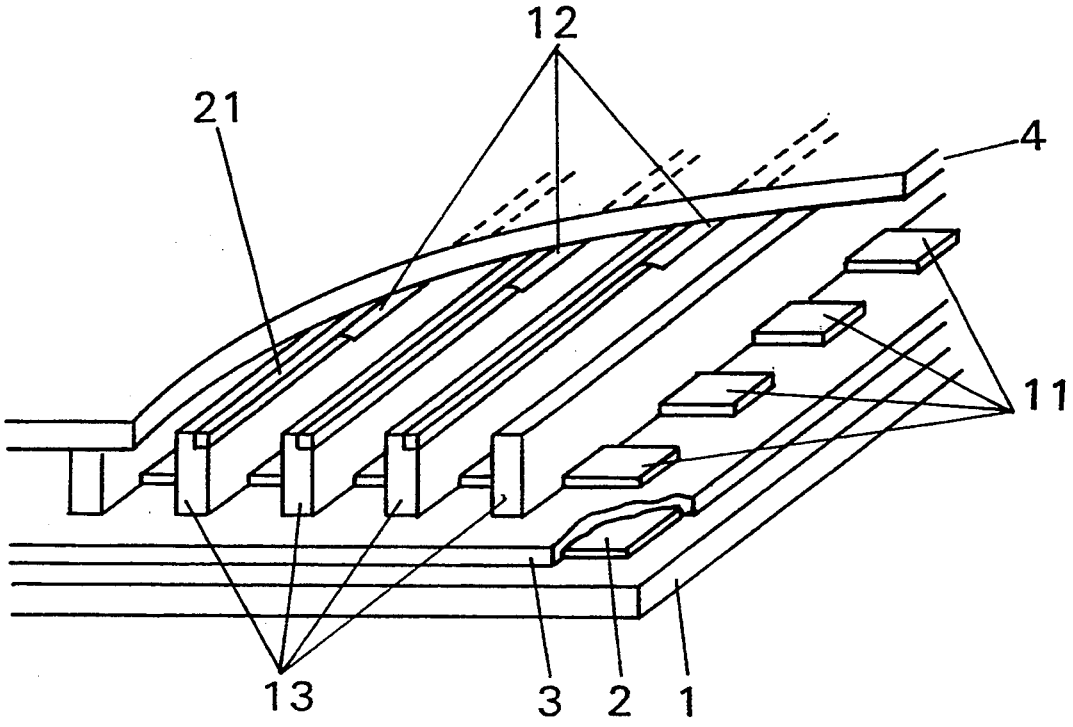
FIG. 9 is a structural view of the plasma display panel in the sixth example of the present invention.

Referring to FIG. 9, the sixth example of the present invention will be described.

The structural difference between this example and the fourth example is that a bus line 21 is provided on each of a plurality of walls 13. The bus line 21 is formed from a material with a high conductivity such as gold and aluminum. The other structure including the driving method is the same as that of the fourth example.

In such a DC-PDP, a transparent electrode, for example, an ITO (indium tin oxide), is generally used as an anode in order to raise the aperture ratio. However, the ITO has such a large resistance that different amounts of currents flow through display cells with different cathodes when a discharge occurs in a plurality of display cells which have the same anode in common. Especially when many cathodes are used, the difference of the currents is revealed as a difference in the display luminance.

In order to solve the problem, the bus lines 21, which are provided on the walls 13, are connected to the anodes 12, thereby allowing most of the current flowing through the ITO to flow through the bus lines 21. Such a structure reduces the voltage drop by the ITO and enables a current of approximately the same amount to flow even if discharges occur in all the display cells which have the same anode in common.

As described above, in the present example, the bus lines 21 provided on the walls 13 in addition to the panel structure of the fourth example reduce the difference of the display luminance.

Example 7

Referring to FIG. 4, the seventh example of the present invention will now be described.

A plurality of cathodes 11 consisting of $K_1$, $K_2$, $K_3$, . . . , etc. are disposed on a backboard 1. A plurality of walls 13 in the shape of strips consisting of $W_1$, $W_2$, $W_3$, . . . , etc. are disposed perpendicular to the cathodes 11, thereby separating the space. L cathodes, for example L=16, are gathered, thereby forming a block. A block wall 20 is provided between each block parallel to the cathodes 11. A plurality of anodes 12 consisting of $A_1$, $A_2$, $A_3$, . . . , etc. are disposed perpendicular to the cathodes 11 above the walls 13 and the block walls 20. Discharge cells 6 are formed on the intersections of cathodes 11 and anodes 12. A glass plate 4 coated with a fluorescent material 5 is provided over the anodes 12. The whole panel is hermetically sealed with a noble gas such as He—Xe—Kr mixed gas and a little mercury inside.

The panel structure of the present example has no wall such as the wall 44 of the conventional panel shown in FIG. 10. Only a block wall 20 to enclose some pieces of cathodes is provided. Discharge cells in each block are opened to each other, which is the essential difference from the panel structure of the conventional pulse memory system.

Thus, mercury easily diffuses uniformly throughout the panel as each discharge cell is not surrounded with walls as used in the conventional panel, resulting in preventing the sputtering of the cathodes and obtaining a long lasting color PDP with a high luminance.

In the panel structure of this example, when the adjacent cathodes are scanned successively, a misdisplay occurs because the panel has no wall parallel to the cathodes. A discharge cell which has just been applied with a writing pulse is kept on discharging by keeping pulses, thereby reducing the ignition voltage of the adjacent cells due to the charged particles produced in the cells in which the discharge occurs. When the adjacent cells are scanned at this time, discharge is started by the scanning pulses even if there is no need to display the cell. Referring to FIG. 5, the driving method to prevent the above misdisplay will now be described.

A plurality of cathodes 11 are divided into n blocks. The cathodes in each block are adjacent to each other. As shown in FIG. 5, the first block, the second block, . . . and the nth block are provided in this order from the bottom. The cathodes included in the mth block are $K_m$, $K_{n+m}$, $K_{2n+m}$, . . . and $K_{(L-1)n+m}$, wherein L is a number of the cathodes included in each block. For example, when the total number of the cathodes is 480, L and n may be taken as 20 and 24, respectively.

In this example, scanning pulses are applied to the cathodes 11 divided into these blocks in the ascending order of the suffixes, that is, in the order of $K_1$, $K_2$, $K_3$, . . . , $K_{Ln-1}$ and $K_{Ln}$. The scanning pulses are applied in the order of the first cathode of the first block, the first cathode of the second block, . . . , the first cathode of the nth block, the second cathode of the first block,..., etc. The waveform for driving the anodes is the same as that of the conventional pulse memory system. The application of a writing pulse to the anode during scanning the cathodes causes a discharge in the discharge cell. The discharge continues until an erasing pulse is applied to the cathodes. Before finishing the application to all the n blocks and starting the application again to the cathodes in the same block, the erasing pulses are applied. This prevents the display discharge from occurring at two cathodes in the same block. Therefore, pulse light emission occurs n times at most in the cell having been applied with a writing pulse. Thus a high display luminance is obtained.

According to this scanning method, one display cell at most is discharged at one time in the area surrounded by the walls 13 and the block walls 20. Moreover, the other display discharges are not effected, thereby preventing misdisplay in spite of the structure with fewer walls.

As described above, in the present example, the walls along the cathodes are removed, thereby diffusing mercury more easily than in the conventional pulse memory system and obtaining a long lasting plasma display panel with a high luminance and the driving method thereof.

Example 8

Referring to FIG. 6, the eighth example of the present invention will now be described.

The structural difference between the present example and the seventh example is that a trigger electrode 2 is coated on a backboard 1, that a dielectric layer 3 is coated on the trigger electrode 2 and that a plurality of cathodes 11, a plurality of walls 13 and the like are disposed on the dielectric layer 3. The other structure is the same as that of the seventh example. The waveforms for driving the anodes 12 and the cathodes 11 are the same as those of the seventh example. A pulse with negative polarity is applied to the trigger electrode 2.

In the PDP of this example, when a writing pulse is applied to a certain cell, discharge does not occur in the adjacent cells, thereby preventing a misdisplay. However, the charged particles as those supplied through the priming paths in the conventional panel are not supplied. Therefore, the ignition voltage is high and a stable discharge is difficult to be kept.

In order to solve the above problem, the trigger electrode 2 of this example acts to produce charged particles all over the panel beforehand, without a supply of the charged particles from the adjacent cells. A pulse with negative polarity is applied to the trigger electrode 2 immediately before scanning a cathode $K_1$. This pulse causes slight pre-discharge in all the discharge cells. Part of the charged particles produced by this pre-discharge are stored on the dielectric layer 3. These stored charged particles cause a discharge when a scanning pulse is applied to each cathode, and the ignition voltage is decreased. Thus, the writing operation is ensured by the trigger electrode 2 when the adjacent cells are not discharged, thereby obtaining a stable discharge.

As described above, in the present example, the trigger electrode is provided in addition to the structure of the seventh example, thereby providing a long lasting plasma display panel with a stable display and a high luminance and the driving method thereof.

According to the present invention, a plasma display panel of the pulse memory system having pixels with enough density for office automation equipment and the driving method thereof. The present invention also provides a long lasting plasma display panel with a stable display and the driving method thereof. Moreover, the present invention further provides a plasma display panel in which circuits to drive the cathodes are easily integrated and the driving method thereof.

In the above example, a method for scanning the cathodes divided into a plurality of blocks is described. However, a method for scanning the anodes divided into a plurality of blocks can provide the same effects.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A method for driving a plasma display panel, said plasma display panel comprising:

a plurality of first electrodes disposed in parallel with each other; and a plurality of second electrodes disposed in parallel with each other and perpendicular to the first electrodes, the second electrodes being indicated by reference numerals $K_1$ to $K_{Ln}$ and divided into a plurality of blocks, a total number of said blocks being n and said blocks being provided from a first block to an n-th block in ascending order, the second electrodes in the respective blocks being L in number and the second electrodes belonging to an m-th block being indicated by reference numerals $K_m$, $K_{n+m}$, - - - , $K_{(L-1)n+m}$ where m is equal to or less than n, the method comprising the steps of:

applying a plurality of scanning pulses sequentially delayed relative to each other to the second electrodes during a plurality of scanning iterations, each of the scanning pulses being applied to one of the second electrodes in ascending order from $K_1$ to $K_{Ln}$, a first scanning pulse being applied to a second electrode belonging to a first block and a second scanning pulse following the first scanning pulse being applied to a second electrode belonging to a second block, applying display pulses corresponding to a display signal to the first electrodes to cause discharge; and applying trains of maintaining pulses to the first electrodes to maintain the discharge.

2. A method for driving a plasma display panel, said plasma display panel comprising:

a plurality of first electrodes disposed in parallel with each other, a plurality of second electrodes disposed in parallel with each other and perpendicular to the first electrodes, the second electrodes being indicated by reference numerals $K_1$ to $K_{Ln}$ and divided into a plurality of blocks, a total number of said blocks being n and said blocks being provided from a first block to an n-th block in ascending order, the second electrodes in the respective blocks being L in number and the second electrodes belonging to an m-th block being indicated by reference numerals $K_m$, $K_{n+m}$, $K_{2n+m}$, - - - , $K_{(L-1)n+m}$ where m is equal to or less than n, and a plurality of walls parallel to the first electrodes, the method comprising the steps of:

applying a plurality of scanning pulses sequentially delayed relative to each other to the second electrodes during a plurality of scanning iterations, each of the pulses being applied to one of the second electrodes in ascending order from $K_1$ to $K_{Ln}$, a first scanning pulse being applied to a second electrode belonging to a first block and a second scanning pulse following the first scanning pulse being applied to a second electrode belonging to a second block, applying display pulses corresponding to a display signal to the first electrodes to cause discharge, and applying trains of maintaining pulses to the first electrodes to maintain the discharge.

3. A method for driving a plasma display panel, said plasma display panel comprising:

a plurality of first electrodes disposed in parallel with each other, a plurality of second electrodes disposed in parallel with each other and perpendicular to the first electrodes, the second electrodes being indicated by reference numerals $K_1$ to $K_{Ln}$ and divided into a plurality of blocks, a total number of said blocks being n and said blocks being provided from a first block to an n-th block in ascending order, the second electrodes in the respective blocks being L in number and the second electrodes belonging to an m-th block being indicated by reference numerals $K_m$, $K_{n+m}$, $K_{2n+m}$, - - - , $K_{(L-1)n+m}$ where m is equal to or less than n, the second electrodes in each of said blocks being adjacent to each other, and discharge spaces formed between the plurality of first electrodes and the plurality of second electrodes, the discharge spaces being formed in a matrix, the method comprising the steps of:

applying a plurality of scanning pulses, which are sequentially delayed relative to each other, to the second electrodes during a plurality of scanning iterations, each of the scanning pulses being applied to one of the second electrodes in ascending order from $K_1$ to $K_{Ln}$ so that during each of the scanning iterations, one of the second electrodes in each of the blocks is pulsed and the second electrodes in each of the blocks are scanned successively, applying writing pulses to the first electrodes so as to start the discharge, applying erasing pulses to the second electrodes after an optional period of time so as to stop the discharge in the discharge spaces, applying display pulses corresponding to a display signal to the first electrodes to cause discharge, and applying trains of maintaining pulses to the first electrodes so as to maintain the discharge, said scanning pulses being applied to not more than one of said second electrodes in any one of said blocks during a selecting period from application of said scanning pulses to application of said erasing pulses.

4. A method for driving a plasma display panel according to claim 1, wherein the second electrodes in each of the blocks are adjacent to each other.

5. A plasma display panel comprising:

a plurality of first electrodes disposed in parallel with each other, a plurality of second electrodes disposed in parallel with each other and perpendicular to the first electrodes, the second electrodes being indicated by reference numerals $K_1$ to $K_{Ln}$ and divided into a plurality of blocks, a total number of said blocks being n and said blocks being provided from a first block to an n-th block in ascending order, the second electrodes in the respective blocks being L in number and the second electrodes belonging to an m-th block being indicated by reference numerals $K_m$, $K_{n+m}$, $K_{2n+m}$, - - - , $K_{(L-1)n+m}$ where m is equal to or less than n, a third electrode, a dielectric layer disposed between the second electrodes and the third electrode, and a driving means for applying a plurality of scanning pulses sequentially delayed relative to each other to the second electrodes during a plurality of scanning iterations, each of the scanning pulses being applied to one of the second electrodes in ascending order from $K_1$ to $K_{Ln}$, a first scanning pulse being applied to a second electrode belonging to a first block and a second scanning pulse following the first scanning pulse being applied to a second electrode belonging to a second block, display pulses corresponding to a display signal being applied to the first electrodes to cause discharge, and trains of maintaining pulses being applied to the first electrodes to maintain the discharge.

6. A plasma display panel according to claim 5, further comprising a plurality of walls among said blocks parallel to the second electrodes, the second electrodes in each of the blocks being adjacent to each other.

7. A plasma display panel according to claim 5, comprising mercury as a discharge gas between the first electrodes and the second electrodes.

8. A plasma display panel according to claim 6, comprising mercury as a discharge gas between the first electrodes and the second electrodes.

9. A plasma display panel comprising:

a plurality of first electrodes disposed in parallel with each other, a plurality of second electrodes disposed in parallel with each other and perpendicular to the first electrodes, the second electrodes being indicated by reference numerals $K_1$ to $K_{Ln}$ and divided into a plurality of blocks, a total number of said blocks being n and said blocks being provided from a first block to an n-th block in ascending order, the second electrodes in the respective blocks being L in number and the second electrodes belonging to an m-th block being indicated by reference numerals $K_m$, $K_{n+m}$, $K_{2n+m}$, - - - , $K_{L-1)n+m}$ where m is equal to or less than n, a third electrode, a plurality of walls parallel to the first electrodes, a dielectric layer disposed between the second electrodes and the third electrode, and a driving means for applying a plurality of scanning pulses sequentially delayed relative to each other to the second electrodes during a plurality of scanning iterations, each of the scanning pulses being applied to one of the second electrodes in ascending order from $K_1$ to $K_{Ln}$, a first scanning pulse being applied to a second electrode belonging to a first block and a second scanning pulse following the first scanning pulse being applied to a second electrode belonging to a second block, display pulses corresponding to a display signal being applied to the first electrodes to cause discharge, and trains of maintaining pulses being applied to the first electrodes to maintain the discharge.

10. A plasma display panel according to claim 9, comprising a plurality of walls among said blocks parallel to the second electrodes, the second electrodes in each of said blocks being adjacent to each other.

11. A plasma display panel according to claim 9, wherein the first electrodes comprise longitudinal axes, the plasma display panel further comprising bus bars made from a highly conductive material connected to the first electrodes, said bus bars being in contact with said first electrodes along said longitudinal axes.

12. A plasma display panel according to claim 10, wherein the first electrodes comprise longitudinal axes, the plasma display panel further comprising bus bars made from a highly conductive material connected to the first electrodes, said bus bars being in contact with said first electrodes along said longitudinal axes.

13. A plasma display panel according to claim 9 comprising mercury as a discharge gas between the first electrodes and the second electrodes.

14. A plasma display panel according to claim 10 comprising mercury as a discharge gas between the first electrodes and the second electrodes.

15. A plasma display panel according to claim 11, comprising mercury as a discharge gas between the first electrodes and the second electrodes.

16. A plasma display panel according to claim 12, comprising mercury as a discharge gas between the first electrodes and the second electrodes.

17. A plasma display panel according to claim 5, wherein the second electrodes in each of the blocks are adjacent to each other.

18. A method for driving a plasma display panel according to claim 2, wherein the second electrodes in each of the blocks are adjacent to each other.

19. A plasma display panel according to claim 7, wherein the second electrodes in each of the blocks are adjacent to each other.

20. A plasma display panel according to claim 8, wherein the second electrodes in each of the blocks are adjacent to each other.

21. A plasma display panel according to claim 9, wherein the second electrodes in each of the blocks are adjacent to each other.

22. A plasma display panel according to claim 11, wherein the second electrodes in each of the blocks are adjacent to each other.

23. A plasma display panel according to claim 13, wherein the second electrodes in each of the blocks are adjacent to each other.

24. A plasma display panel according to claim 15, wherein the second electrodes in each of the blocks are adjacent to each other.

* * * * *